US007230814B2

(12) United States Patent
Speiser

(10) Patent No.: US 7,230,814 B2
(45) Date of Patent: Jun. 12, 2007

(54) DIGITAL SQUIB

(76) Inventor: Gary Speiser, Kfar Hashiloach, Ir-David, Jerusalem (IL)

( * ) Notice: Subject to any disclaimer, the term of this patent is extended or adjusted under 35 U.S.C. 154(b) by 91 days.

(21) Appl. No.: 11/101,294

(22) Filed: Apr. 7, 2005

(65) Prior Publication Data

US 2005/0231888 A1 Oct. 20, 2005

Related U.S. Application Data

(60) Provisional application No. 60/563,670, filed on Apr. 19, 2004.

(51) Int. Cl.
*F23Q 7/02* (2006.01)

(52) U.S. Cl. ..... 361/248; 102/206

(58) Field of Classification Search ..... 361/249, 361/248; 102/206, 210, 218
See application file for complete search history.

(56) References Cited

U.S. PATENT DOCUMENTS 5,435,248 A * 7/1995 Rode et al. ..... 102/210
5,476,044 A * 12/1995 Boucher ..... 102/218
5,564,737 A * 10/1996 Ito et al. ..... 280/735
6,300,764 B1 * 10/2001 Kelley ..... 324/502
6,729,240 B1 * 5/2004 Smith et al. ..... 102/206

* cited by examiner

*Primary Examiner*—Stephen W. Jackson
*Assistant Examiner*—Danny Nguyen
(74) *Attorney, Agent, or Firm*—Ostrolenk, Faber, Gerb & Soffen, LLP

(57) ABSTRACT

An intelligent switch system, a so-called squib, for providing power to sensitive equipment, such as missiles, rockets and the like, comprises a pair of serially connected power switches which are separately and sequentially enabled and which will not deliver power from their input to their outputs unless both switches turn on. These switches are controlled by an electronic microcontroller that is normally left unpowered, except when a trigger input is temporarily applied to the microcontroller.

14 Claims, 4 Drawing Sheets

| PIN NO. | FUNCTION |
|---|---|
| 1 | NC |
| 2 | GND |
| 3 | VIN |
| 4 | VIN |
| 5 | VIN |
| 6 | PROTECT |
| 7 | ~~GND~~ PROTECT |
| 8 | GND |
| 9 | GND |
| 10 | VOUT |
| 11 | VOUT |
| 12 | VOUT |
| 13 | GND |
| 14 | GND |
| 15 | ~~GND~~ POWER SW |
| 16 | POWER SW |

DIGITAL SQUIB

CROSS REFERENCE TO RELATED APPLICATIONS

This application claims the benefit and priority of U.S. Provisional patent application Ser. No. 60/563,670 filed Apr. 19, 2004 entitled DIGITAL SQUIB, the entire disclosure of which is incorporated herein by reference.

BACKGROUND OF THE INVENTION

The present invention relates to squibs and, more particularly, to electronically controlled digital squibs. Squibs are electrical switches with a built-in, ultrasecure mechanism to prevent accidental turn on of the switch.

Rockets, missiles, space platforms, drilling equipment, remote robotic controls and the like, have triggerable systems or devices which, when triggered or launched, result in significant events that cannot be easily reversed or stopped. Therefore, very elaborate steps are taken in the design of squibs to assure foolproof operation without any chance for accidental triggering of the switching device.

Conventional squibs are expensive, elaborate and electromechanical, as well as chemical, devices which sometimes include explosive components that destroy a trigger prevention protector when it is decided that the squib is to be enabled. It would be advantageous to obtain a squib that avoids the drawbacks of conventional squibs, including relative to the complexity, construction and cost thereof and obtain a squib with enhanced programmability and versatility features.

SUMMARY OF THE INVENTION

It is an object of the present invention to provide a squib that is not pyrotechnically operable, can be safely reset to its initial state, and comprises programmable timing for turning on, i.e. "firing".

Another object of the invention is to provide an electronically controlled squib.

The foregoing and many other objects of the invention are realized with an electronic squib which incorporates several levels of protection such as to meet the requirements and specifications for conventional squibs, that are typically utilized in providing power to sensitive equipment, such as missiles, rockets, space platforms, drilling equipment, remote robotic controls and the like.

Essentially, the intelligent squib of the present invention comprises a pair of serially connected power switches which are separately and sequentially enabled and which will not deliver power from their input to their outputs unless both switches turn on. These switches are controlled by an electronic microcontroller that is normally left unpowered, except when a trigger input (VOLTAGE) is temporarily applied to the microcontroller, which then begins its operation by enabling the first of the pair of series switches and at the same time, becomes electrically powered from the enablement of the first switch.

Other features and advantages of the present invention will become apparent from the following description of the invention which refers to the accompanying drawings.

DETAILED DESCRIPTION OF PREFERRED EMBODIMENTS OF THE INVENTION

Figure 1:
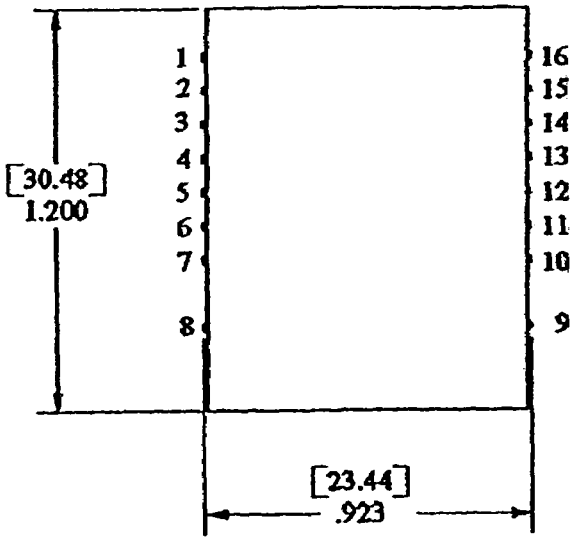
FIG. 1 is a mechanical drawing of the digital squib of the present invention.

FIG. 1 illustrates the layout and dimensional sizes, as well as pin assignment for an intelligent, digital squib constructed in accordance with one PCB (printed circuit board) layout thereof, although it should be appreciated that the varieties and possibilities for the layout of the device is virtually infinite. Nonetheless, and in accordance with FIG. 1, there is illustrated a dual inline package which utilizes 16 pins.

Figure 2A:
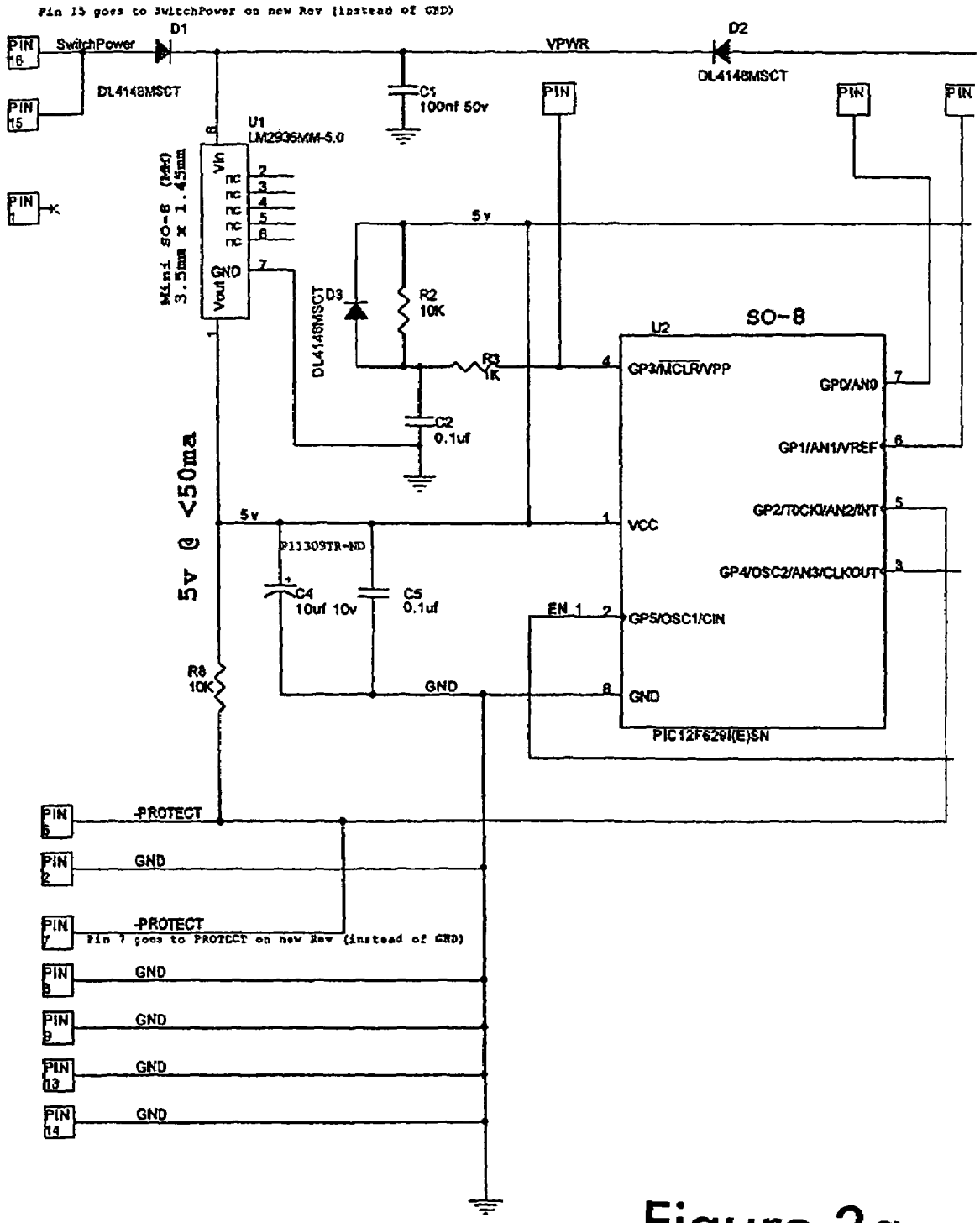
FIGS. 2*a* and 2*b* are circuit diagrams of the digital squib of the present invention, with FIG. 2*b* representing the continuation of FIG. 2*a*.
Figure 2B:
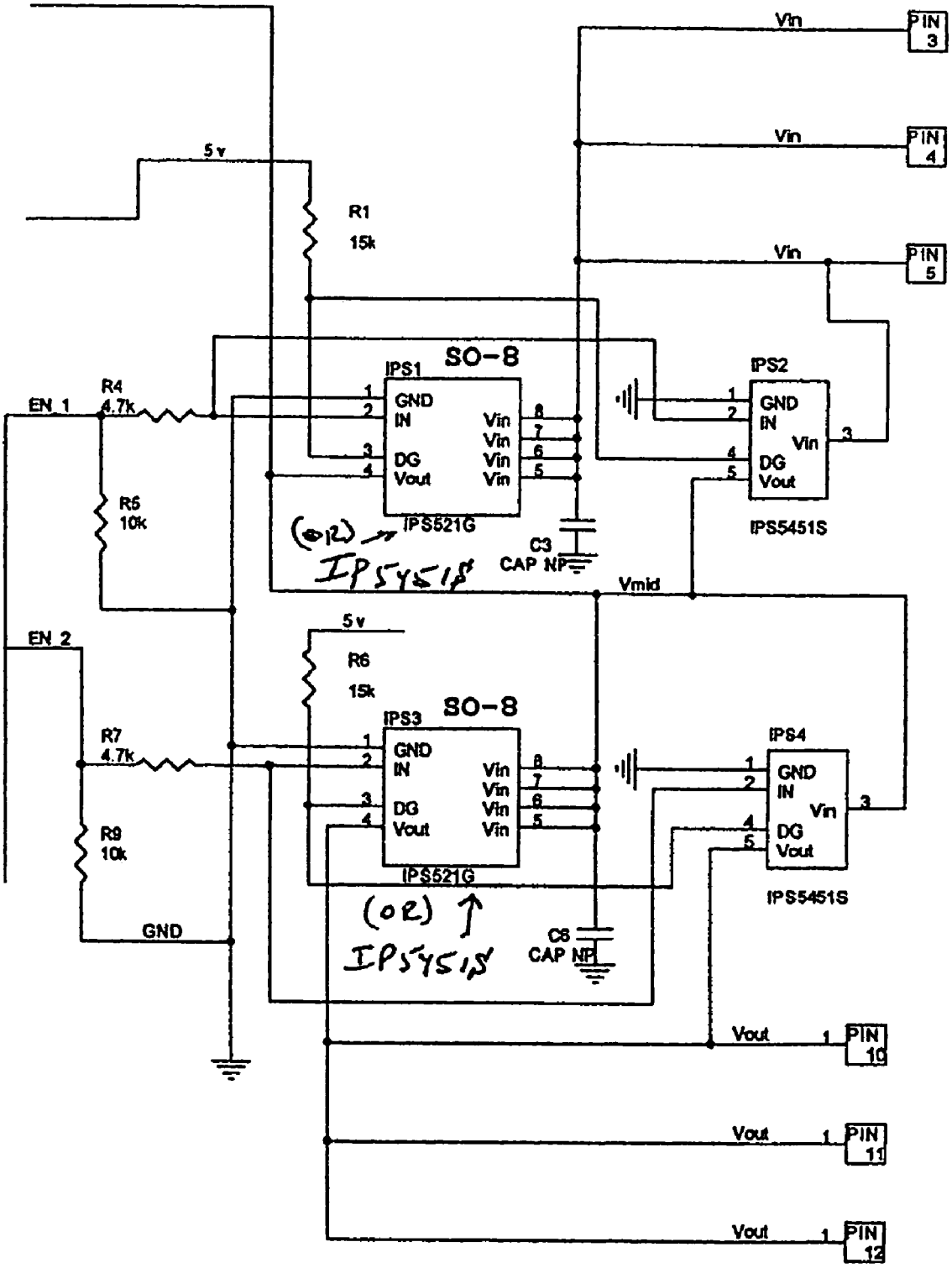

Turning to FIG. 2, it is noted that the main component of the squib comprises the microcontroller denominated as integrated circuit (IC) U2 which can preferably be a PIC12F6291(E)SN device. The main power switches are denominated as IPS1 and IPS3 and each preferably comprises an IPS521G FET switch.

The operational concept of the intelligent squib of FIG. 2 can be appreciated from the following generalized description of the illustrated circuit. Thus, when a momentary power pulse is applied as a signal switch power at PIN 16 (or PIN 15), the power flows through the diode D1 to the U1 integrated circuit which produces a power supply voltage of 5v at 50 ma, at the power input PIN 1 (VCC) of the microcontroller U2. If the protect signal at PIN 6 is in a state that does not disable the microcontroller U2, it issues a first enabling signal to the IPS1 FET as a signal EN 1. This causes the FET switch IPS1 to close (turn on), providing an output voltage signal. This causes the voltage to appear at the Vout PIN 4 of the IPS1 switch which then supplies power as in input power to the voltage regulator U1 (for example, an LM2936MM-5.0 device), which then permits the microcontroller U2 to continue to be powered, even after the SwitchPower signal at PIN 16 of the device has been removed.

Subsequently, and after a programmable time delay, the microcontroller issues a second enable signal EN 2 which is provided to the second FET switch IPS3. Once the second switch is enabled, the power signal which is provided as a Vin voltage at the device pins 3, 4 and 5, ultimately appears as the Vout signal at the device pins 10, 11 and 12. It is this Vout signal at the pins 10, 11 and 12 that is supplied to the ultimately controlled device being controlled, e.g., the missile, rocket, etc. The pair of FET switches identified as parts IPS2 and IPS4 (utilizing IPS5451S FETs) can be utilized for lower voltage but higher sustained current applications. The PCB is designed to accept either type of FET device.

Figure 3:
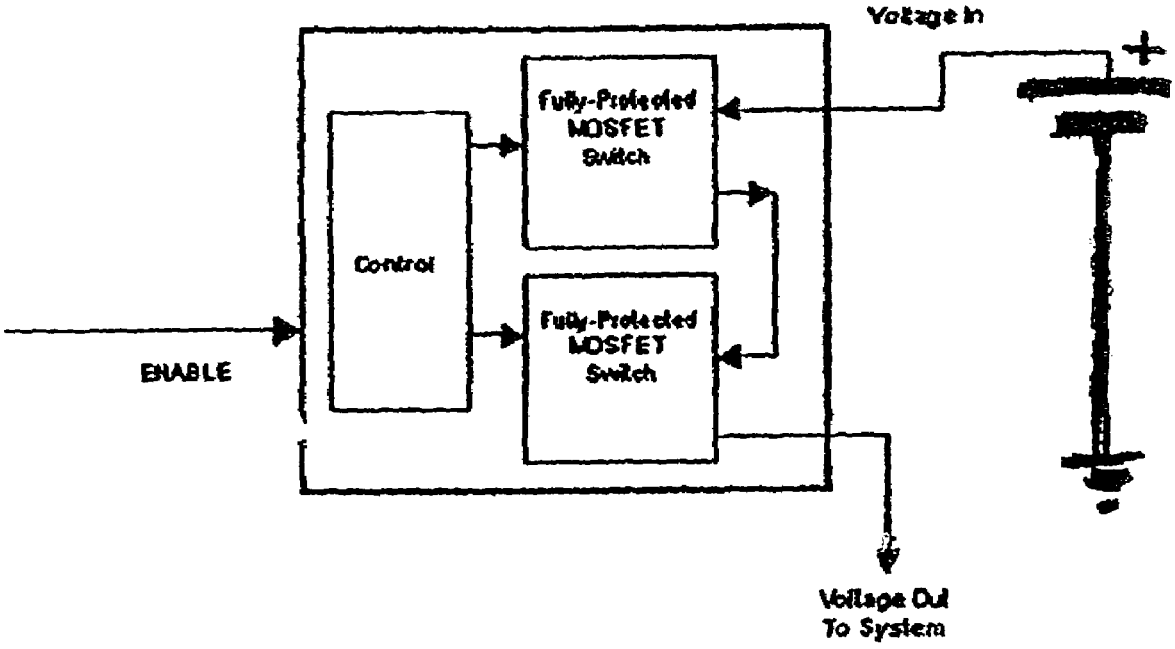
FIG. 3 is a block diagram of the digital squib of the present invention.

FIG. 3 is a block diagram of the circuit of FIG. 2 showing the control device and the fully protected MOSFET switches, as described above.

The intelligent squib of the present invention has been constructed and found to be highly reliable and well protected. It can be provided in normally open or closed models. It can handle inductive loads and its protection includes short circuit ESD, user fully protected power MOSFET switches utilizing the above-described two-level in-series MOSFETS. The novel device can provide programmable delay from enable to circuit closure and it can be provided in small package sizes, as well as in surface mounted technology packages or in conventional dual inline construction.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical, digital switch system for supplying power to a load, the switch system including a built-in secure mechanism to prevent accidental turn on of the load, the switch system comprising:

a controller and input circuit for receiving a pulse of temporary power for powering the controller, the controller being unpowered prior to receipt of the pulse of temporary power, the controller being operable to produce a first enable output and after a time delay a second enable output;

a first switch coupled to the first enable output and being operable responsive thereto to provide a first output voltage, said first output voltage being coupled to said controller to continue powering said controller even after said pulse of temporary power has been inactivated; and a second switch coupled to the first output voltage and coupled to the second enable output and being responsive thereto to provide a second output voltage which is suitable for being coupled to supply power to the load.

2. The digital switch system of claim 1, wherein the controller comprises a digital circuit.

3. The digital switch system of claim 2, wherein the first switch and the second switch comprise a respective field effect transistor.

4. The digital switch system of claim 2, wherein the input circuit includes a diode.

5. The digital switch system of claim 2, including a disable signal input for the controller which renders the controller inoperable, even in the presence of the pulse of temporary power.

6. The digital switch system of claim 2, including a printed circuit board having socket arrangements for receiving and housing the controller, and the first switch and the second switch.

7. The digital switch system of claim 6, wherein the printed circuit board includes a pair of sockets to accommodate a third switch for use, instead of the first switch, and a fourth switch for use instead of the second switch.

8. The digital switch system of claim 7, wherein the first and second switches are operable to output a first high voltage at a lower first current and whereas the third and the fourth switches are operable to output a second voltage lower than the first voltage and to produce a second current higher than that the first current.

9. The digital switch system of claim 2, wherein the controller includes a delay circuit for delaying outputting the second enable output for a predetermined time period after activation of the first enable output.

10. The digital switch system of claim 9, wherein the predetermined delay is programmable.

11. A method of switching an electrical output to supply power to a load in a manner which prevents accidental turn-on of the load, the method comprising the steps of:

providing a pulse of temporary power to a previously unpowered digital controller of the type that is operable to produce a first enable output and after a time delay a second enable output;

applying the first enable output of the controller to a first switch which is operable in response to the first enable output to provide a first output voltage and coupling back the first output voltage of the first switch to the digital controller to continue powering the digital controller even after said pulse of temporary power has been inactivated; and applying the first output voltage to a second switch and coupling the second enable output to the second switch to cause the second switch to provide in response thereto, a second output voltage which is suitable for being coupled to supply power to the load.

12. The method of claim 11, including applying the pulse of temporary power through a diode.

13. The method of claim 11, including selectively applying a disable signal to the controller to render the controller inoperable, even in the presence of the pulse of temporary power.

14. The method of claim 11, including the outputting of the second enable output relative to the first enable output.

* * * * *